United States Patent [19]

Rautakorpi

[11] Patent Number: 4,887,362

[45] Date of Patent: Dec. 19, 1989

[54] METHOD AND AN APPARATUS FOR DRYING A PAPER WEB OR THE LIKE

[75] Inventor: Paavo Rautakorpi, Tampere, Finland

[73] Assignee: Oy Tampella AB, Tampere, Finland

[21] Appl. No.: 147,136

[22] Filed: Jan. 22, 1988

[30] Foreign Application Priority Data

Feb. 5, 1987 [FI] Finland ..... 870483

[51] Int. Cl.[4] ..... F26B 3/32

[52] U.S. Cl. ..... 34/41; 34/66; 34/73; 34/162; 34/216

[58] Field of Search ..... 34/156, 122, 148, 152, 34/155, 12, 14, 41, 70, 73, 162, 216, 66; 162/33

[56] References Cited

U.S. PATENT DOCUMENTS 3,216,129 11/1965 Jepson ..... 34/156

4,506,456 3/1985 Lehtinen ..... 34/73 X 4,506,457 3/1985 Lehtinen .

*Primary Examiner*—Henry A. Bennet

*Attorney, Agent, or Firm*—Nixon & Vanderhye

[57] ABSTRACT

The invention relates to a method and an apparatus for drying a paper web or the like. In the invention the web to be dried is transferred on a felt between bands moving around as an endless loop. The band making contact with the web is heated by means of a steam chamber, and the band making contact with the felt is supported and cooled within the area of the steam chamber by means of supporting and cooling means. For providing a rapid compensation of pressure differences, the supporting and cooling means is formed by a hydrostatic plate comprising a plurality of pressure pockets and return conduits separated from each other by means of ridges. Water is fed into the pressure pockets so that it enters the return conduits over the ridges. The pressure of the return conduits is adjusted on the basis of the pressure of the steam contained in the steam chamber.

13 Claims, 1 Drawing Sheet

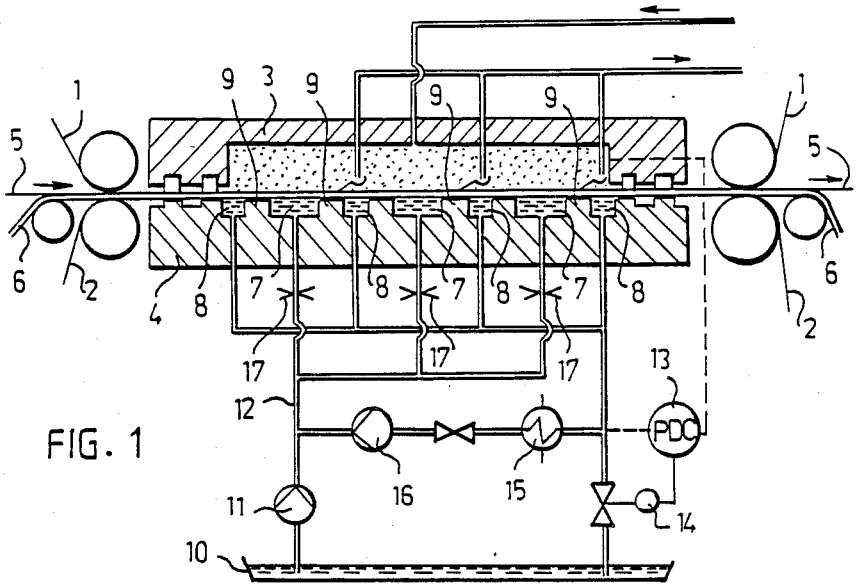
FIG. 1
FIG. 2
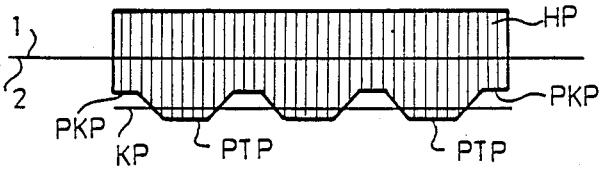
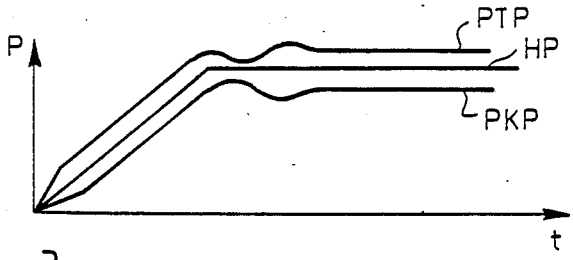
FIG. 3

METHOD AND AN APPARATUS FOR DRYING A PAPER WEB OR THE LIKE

The invention relates to a method for drying a paper web or the like, wherein the web to be dried is transferred on a drying felt or wire between endless bands having good heat conducting properties so that one band makes contact with the web to be dried and the other with the drying felt or wire, whereby the band in contact with the web is heated by means of a steam chamber and the band in contact with the drying felt or wire is supported and cooled within the area of the stream chamber by means of supporting and cooling means. The invention is also concerned with an apparatus for applying said method.

Methods and apparatuses of this type are today well-known in paper industries. Such solutions include the method and apparatus disclosed in Finnish Patent Specification 63 078.

In the solution of Finnish Patent Specification 63 078, pressure chambers positioned opposite to each other contain different media. One chamber contains steam and the other water. The chambers are separated from each other by means of movable bands between which a web to be dried is passed forwards on a felt or wire. The pressure difference between the chambers has to be very accurately controlled under all circumstances, even at the heating stage. With a full-size dryer, e.g. 7.5×30 m in size, a pressure difference as small as 0.1 bar between the chambers will cause a load of 225,000 kp to be exerted on the bands, which the bands do not withstand without any additional support. The support, in turn, causes a high frictional force. It may be mentioned as an example of such frictional forces that a friction coefficient as small as 4% will cause a frictional force of 9,000 kp, which affects the driving output at a speed of 10 m/s with about 883 kW. A further problem is that the sealing is difficult to effect if the bands cannot be kept straight. The prior art does not provide a sufficiently accurate pressure control between the chambers nor a sufficiently low friction.

The object of the invention is to provide a method and an apparatus which eliminates the drawbacks of the prior art. This is achieved by means of a method and an apparatus according to the invention, which method is characterized in that the supporting and cooling means is a hydrostatic plate comprising a plurality of pressure pockets and return conduits separated from each other by means of ridges supported on the underside of the band, that a suitable amount of water is fed into the pressure pockets so that the water enters the return conduits from between the ridges and the band, and that the pressure of the return conduits is adjusted on the basis of the pressure of the stream contained in the steam chamber. The apparatus according to the invention, in turn, is characterized in that the supporting and cooling means is formed by a hydrostatic plate comprising a plurality of pressure pockets and return conduits separated from each other by mens of ridges supported on the underside of the band, that water is arranged to be fed into the pressure pockets so that the water enters the return conduits from between the ridges and the band, and that the pressure of the return conduits is arranged to be adjusted on the basis of the pressure of the steam contained in the steam chamber.

An advantage of the invention is mainly that the pressure difference between the chambers can be controlled in a very accurate and rapid way, because the clearance between the band and a ridge is determined on the basis of the pressure balance of the steam chamber and the water plate, whereby the band participates in the control process. Furthermore, the band is kept straight and in contact with the surface because each pressure pocket is controlled separately. The contact between the band and the plate can be prevented by means of the water film, whereby no wear occurs and the friction is very low. The hydrostatic water plate cools the band efficiently and evenly. By virtue of the low friction, the control of the bands is easier and savings obtained in the rotational power amount to thousands of kilowatts.

The invention will be described in the following in more detail by means of an embodiment shown in the attached drawing, whereby FIG. 1 is a general view of an apparatus according to the invention, FIG. 2 illustrates the pressure distribution in the apparatus of FIG. 1, and FIG. 3 illustrates graphically pressure variations in a pressure pocket and return conduits as a function of time.

FIG. 1 shows generally an apparatus according to the invention which comprises two bands 1, 2 impermeable to liquid and having smooth surface finish. The bands are made of a material having good heat conducting properties and it moves around in the form of an endless loop. The apparatus further comprises a steam chamber 3 intended for heating the band 1 and a hydrostatic plate 4 acting as supporting and cooling means for the band 2.

FIG. 1 shows only that portion of the path of the bands 1, 2 in which the band move adjacent to and in parallel with each other in such a manner that the band 1 makes contact with a web 5 to be dried when it is led between the bands, and the band 2, in turn, makes contact with a drying felt or wire 6 supporting the web to be dried. The web 5 to be dried and the drying felt or wire 6 are thus positioned between the bands 1, 2 over the entire width thereof simultaneously as the bands are pressed against the web and the felt. The felt 6 is arranged to move around as an endless loop in a manner known per se.

For drying the web the band 1 is heated by means of the steam chamber 3. The band 1 thereby forms one wall of the chamber. The band 2 is cooled and supported within the area of the steam chamber 3 by means of the hydrostatic plate 4.

With the exception of the hydrostatic plate, the drying arrangement described above and the operating principle thereof form part of the prior art, so these matters are not described in more detail in this connection. As to the operating principle of the drying arrangement, Finnish Patent Specification 63 078, for instance, is referred to. It is herein to be merely stated in brief that the function of the apparatus according to the figure is to remove the moistness contained in the web 5 and to transfer it into the drying felt or wire 6 by means of which the moistness can be passed into a desired location so that it can be removed from the felt.

The following description will be focused on the structure and operation of the hydrostatic plate. The hydrostatic plate 4 comprises a plurality of pressure pockets 7 and return conduits 8 positioned alternately one after another in the direction of movement of the web 5. The pressure pockets 7 and the return conduits 8 are separated from each other by means of ridges 9. The band 2 is supported on the ridges 9. In the figure, the bands move from the left to the right.

According to the invention water is fed into the pressure pockets 7 so that it enters the return conduits 8 from between the ridges 9 and the band 2. The pressure of the return conduits is adjusted on the basis of the pressure of the steam contained in the steam chamber 3. The pressure of the return conduits 8 is preferably adjusted to a value slightly lower than the pressure of the steam contained in the steam chamber 3, whereby the pressures of the pressure pockets 7 rise to a value slightly higher than the pressure of the steam chamber 3 as a result of the steam pressure of the chamber 3 and a pressure disturbance occurring in the ridges 9. The clearances between the ridges 9 and the band 2 are determined by the flow rates and the pressure differences automatically and separately for each pressure pocket.

FIG. 1 shows generally the arrangement for feeding water. The reference numeral 10 indicates a water container. Water is fed by means of a pump 11 through a supply conduit 12 into the pressure pockets 7. The supply conduit 12 comprises regulating means 17 for feeding a suitable amount of water into each pressure pocket 7. From the pressure pockets 7 the water enters the return conduits 8 over the ridges 9 as mentioned above. The pressure of the return conduits 8 is adjusted by means of measuring the adjusting means 13, 14 on the basis of the pressure of the steam chamber. FIG. 1 further shows a heat exchanger 15 and a pump 16 by means of which the amount of the circulation water of the plate 4 can be preferably increased, whereby the heat required for the drying process is removed by means of the heat exchanger 15.

In a way, the moving bands 1, 2 thus form part of the adjusting circuit. The steam pressure causes the gaps formed between the ridges and the band 2, the pressure losses occurring adjacent to the ridges, and the pressures of the pressure pockets to be adjusted to values such that the average pressure of the water chamber follows strictly the pressure of the steam chamber. In addition, each pressure pocket acts as its own adjusting circuit, thus preventing the bands from rising out of contact with the plate. FIGS. 2 and 3 illustrate the behaviour of the pressures at different points and as a function of time. In FIG. 2, the reference KP represents the average pressure. The reference PTP, in turn, represents the pressure of a pressure pocket, and the reference PKP the pressure of the return conduit. The portion Hp above the bands represents the pressure of the steam chamber. FIG. 3, in turn, shows that the pressure of the pressure pocket and that of the return conduit (the average pressure) follow strictly the steam pressure even in situations when the pressure varies.

The above embodiment is by no means intended to restrict the invention, but the invention can be modified as desired within the scope of the claims. Accordingly, it is to be understood that the apparatus according to the invention or the parts thereof need not be exactly similar to those shown in the figures, but other kind of solutions are possible as well. The shape, position, size, and number of the pressure pockets and the return is not restricted, so these details can be chosen as desired according to the requirements in each case. The adjusting operations can also be effected in any manners known per se, etc.

I claim:

1. A method for drying a paper web comprising the steps of:

(a) transferring the web on a drying surface between a pair of endless bands so that one of said pair of endless bands engages the paper web to be dried, and the other of said pair of endless bands engages the drying surface;

(b) heating said one band by means of steam in a steam chamber partially defined by said one band;

(c) simultaneously cooling said other band in an area below said steam chamber by hydrostatic plate means provided with a plurality of pressure pockets and return conduits separated by ridge means which provide support for said other band, wherein, during the practice of step (c), water is fed into the pressure pockets and passes between the ridge means and said other band into said return conduits; and (d) adjusting pressure in said return conduits as a function of steam pressure in the steam chamber.

2. A method according to claim 1, wherein the return conduits surround the pressure pockets.

3. A method according to claim 1, wherein during step (d), the pressure of the return conduits is adjusted to a value slightly lower than the pressure of the steam contained in the steam chamber.

4. A method according to any of claims 1 or 2, wherein said pair of bands participate in the adjustment of pressure in the pressure pockets.

5. An apparatus for drying a paper web or the like, comprising a drying surface for transporting the web to be dried, a pair of endless bands moving in an endless loop, whereby the pair of bands move over a portion of their path in parallel relation to each other on opposite sides of and in engagement with, the web and the drying surface thereby enclosing the web over its entire width thereof between the pair of bands; a steam chamber for heating the band engaging the web; means for supporting and cooling the band engaging the drying surface within the area of the steam chamber, said means for supporting and cooling the band being formed by a hydrostatic plate comprising a plurality of pressure pockets and return conduits separated from each other by means of ridges; means for feeding water into the pressure pockets so that the water enters the return conduits from between the ridges and the band engaging the support surface; and means for adjusting the pressure in the return conduits as a function of the pressure of the steam contained in the steam chamber.

6. An apparatus according to claim 5, wherein the pressure pockets and the return conduits are arranged alternately one after another.

7. An apparatus according to claim 5, wherein the return conduits are arranged to surround the pressure pockets.

8. A method according to claim 3 wherein said pair of bands participate in the adjustment of pressure in the pressure pockets.

9. A method according to claim 1 wherein each of said pair of bands is heat conductive.

10. An apparatus according to claim 5 wherein each of said pair of bands is heat conductive.

11. A method according to claim 1, wherein the pressure pockets and the return conduits are positioned alternately one after another.

12. A method according to claim 1 including adjusting the pressure in the return conduits to a value slightly lower than the pressure of the steam contained in the steam chamber.

13. A method according to claim 12 including adjusting the pressure in the pressure pocket to a value slightly higher than the pressure of the steam contained in the steam chamber.

* * * * *